US012312743B1

(12) United States Patent
Ratigan

(10) Patent No.: US 12,312,743 B1
(45) **Date of Patent: *May 27, 2025**

(54) KNOT PROTECTOR

(71) Applicant: Michael Ratigan, Elon, NC (US)

(72) Inventor: Michael Ratigan, Elon, NC (US)

(73) Assignee: Fjord, Inc., Graham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/513,824

(22) Filed: Nov. 20, 2023

Related U.S. Application Data

(63) Continuation of application No. 17/449,828, filed on Oct. 4, 2021, now Pat. No. 11,821,138.

(51) Int. Cl.
*D07B 1/16* (2006.01)
*A63B 29/02* (2006.01)

(52) U.S. Cl.
CPC ..... *D07B 1/162* (2013.01); *A63B 29/02* (2013.01); *D07B 2205/2046* (2013.01); *D07B 2301/305* (2013.01); *D07B 2401/2075* (2013.01)

(58) Field of Classification Search
CPC ..... D07B 1/162; A63B 29/02
See application file for complete search history.

(56) References Cited

U.S. PATENT DOCUMENTS 2,125,451 A 8/1938 Kolliner
2,656,763 A 10/1953 Frost
3,837,007 A 9/1974 Girest
4,542,597 A 9/1985 Baptista et al.
6,085,695 A 7/2000 Miller et al.
6,263,610 B1 7/2001 Doubts, Jr.
6,920,642 B2 7/2005 Dickens
7,200,870 B1 4/2007 Kolk
D634,900 S 3/2011 Eff
D636,597 S * 4/2011 McCabe ..... D16/237
7,921,470 B2 4/2011 Doran
7,926,702 B2 * 4/2011 Childs ..... B65D 29/00 383/105
7,930,806 B2 4/2011 Funk
D640,420 S 6/2011 Miller et al.
8,028,834 B2 * 10/2011 Lill ..... A61M 16/101 206/702
D693,559 S 11/2013 Gregoire
9,301,553 B1 4/2016 Donovan
10,539,391 B2 * 1/2020 Bridgman, Jr. ..... F41G 1/383
D917,835 S * 5/2021 Onderick ..... D2/858
(Continued)

*Primary Examiner* — Shaun R Hurley
(74) *Attorney, Agent, or Firm* — Tuggle Duggins P.A.; Blake P. Hurt; Reinier R. Smit

(57) ABSTRACT

The knot protector protects ropes and knots from ledges, rocks, railings, edges, walls, cliffs, and other surfaces that may cause the fibers of the rope to be gradually abraded or destroyed. The knot protector includes a sleeve formed from an upper portion, a lower portion, and a shoulder portion. The upper portion defines a first opening while the lower portion defines a second opening. The diameter of the first opening is smaller or less than that of the second opening. The sleeve is formed from a deformable, continuous web and has exterior and interior layers. The sleeve also contains visual safety indicators along the base of the lower portion to provide visibility. The exterior and interior layers are made from durable material to provide the rope with ample protection from abrasion.

18 Claims, 9 Drawing Sheets

(56) References Cited

U.S. PATENT DOCUMENTS

| | | | | |
|---|---|---|---|---|
| 11,821,138 | B1 * | 11/2023 | Ratigan | D07B 1/162 |
| 2002/0170727 | A1 | 11/2002 | Holland et al. | |
| 2003/0029470 | A1 | 2/2003 | Srivastava | |
| 2005/0120461 | A1 | 6/2005 | Dickens | |
| 2006/0256546 | A1 | 11/2006 | Amaral | |
| 2014/0357388 | A1 * | 12/2014 | Morgan | A63G 9/00<br>472/118 |
| 2016/0008637 | A1 * | 1/2016 | Peters | A62B 1/02<br>182/70 |
| 2016/0264328 | A1 | 9/2016 | Barger | |
| 2016/0279477 | A1 | 9/2016 | Petty et al. | |
| 2017/0036056 | A1 | 2/2017 | Tomellini et al. | |
| 2017/0049427 | A1 | 2/2017 | Do et al. | |
| 2018/0220624 | A1 | 8/2018 | Bussell et al. | |

* cited by examiner

KNOT PROTECTOR

This is a continuation of and claims benefits under pending prior application Ser. No. 17/449,828 filed 4 Oct. 2021, which is incorporated by reference in its entirety herein.

FIELD OF THE INVENTION

The disclosure herein pertains to rope protection devices generally, and particularly pertains to knot protection devices for protecting ropes and knots from abrasion and damage during use.

DESCRIPTION OF THE PRIOR ART AND OBJECTIVES OF THE INVENTION

Ropes are necessary to safely perform work duties for those who work as police officers, roofers, firefighters, rescuers, window washers, and military personnel. Many activities including wall and mountain climbing, scaling cliffs and ledges, or ascending and descending from the tops of roofs, ledges, cliffs, boilers, caves, and ship hulls also require the use of ropes for carrying heavy loads. These activities require the ropes to pass over ledges, rocks, railings, edges, walls, cliffs, and other surfaces that may cause the fibers of the rope to be gradually abraded or damaged. This may occur especially if a climber is hauling heavyweight bags up a wall or mountain which places significant pressure and weight on the rope. The ropes are typically tied into knots which, owing to their geometry, also require protection. When a haulbag is dragged up uneven or blocky surfaces, over roofs or any other non-uniform substrates, the knot continuously rubs against the rock or surface and causes abrasion on the rope surface, and eventually results in the degradation of the rope. The destruction of the ropes can compromise the load-bearing capabilities of the rope and expose the user to danger. In an effort to protect the ropes from abrasion and damage, adding a knot protector significantly helps to increase the lifespan of the haul rope.

It is known in the art to simply cut a small plastic bottle in half and smooth the edges with sand paper or duct tape as a form of knot protection. Though cheap and easy to make, plastic also wears and may not be considered the most durable form of protection for ropes, and more particularly rope knots. Users of the ropes may also find it necessary to use the ropes at nighttime. For example, firefighters are often called to perform their duties in the evening hours. Additionally, climbers may spend nights on walls, ledges, or mountains and may need some form of visual aid. With little to no lighting at night, it is important for rescuers, climbers, and those working during the night to be provided with visibility and safety by the use of visual safety indicators. It is also important to have a reliable product to provide sufficient support to ropes and knots. No past disclosures have provided knot protectors that deliver flexibility and durability along with the ability to conform to the size and shape of any knot or rope configuration. Thus, in view of the problems and disadvantages associated with prior art devices, the present disclosure was conceived and one of its objectives is to provide a knot protector with increased versatility and use.

It is another objective of the present disclosure to provide a knot protector that has functionality to protect ropes and knots from abrasion and destruction.

It is still another objective of the present disclosure to provide a knot protector that provides load-bearing support.

It is yet another objective of the present disclosure to provide a knot protector that incorporates visual safety indicators.

It is still yet another objective of the present disclosure to provide a knot protector that is durable, long lasting, and easy to manufacture.

Various other objectives and advantages of the present disclosure will become apparent to those skilled in the art as a more detailed description is set forth below.

SUMMARY OF THE INVENTION

A knot protector for protecting ropes and knots from abrasion and damage while providing sufficient support is disclosed herein. The knot protector includes a sleeve formed from an upper portion, a lower portion, and a shoulder portion. The sleeve is sized, shaped, and otherwise configured to receive a knot from a rope which is then positioned within the upper portion of the sleeve. The sleeve is made from durable material which protects the rope from ledges, rocks, railings, edges, walls, cliffs, and other surfaces that may cause the fibers of the rope to be gradually abraded or degraded. The upper portion defines a first opening and the lower portion defines a second opening. The first opening has a diameter that is smaller than the diameter of the second opening. The sleeve is formed from a deformable, continuous web and includes exterior and interior layers. The exterior layer is formed from a 1000 denier nylon material and the interior intermediate layer is formed from a 1000 denier nylon material and/or a 1680 denier nylon material. Both the interior and exterior layers are formed from a nylon material woven into a herringbone weave pattern. Additionally, the herringbone nylon weave of the exterior layer is formed from a 0.25 inch thick nylon webbing. The sleeve also contains visual safety indicators along the base of the lower portion to provide visibility.

DETAILED DESCRIPTION OF THE PREFERRED EMBODIMENT AND OPERATION OF THE INVENTION

Figure 1:
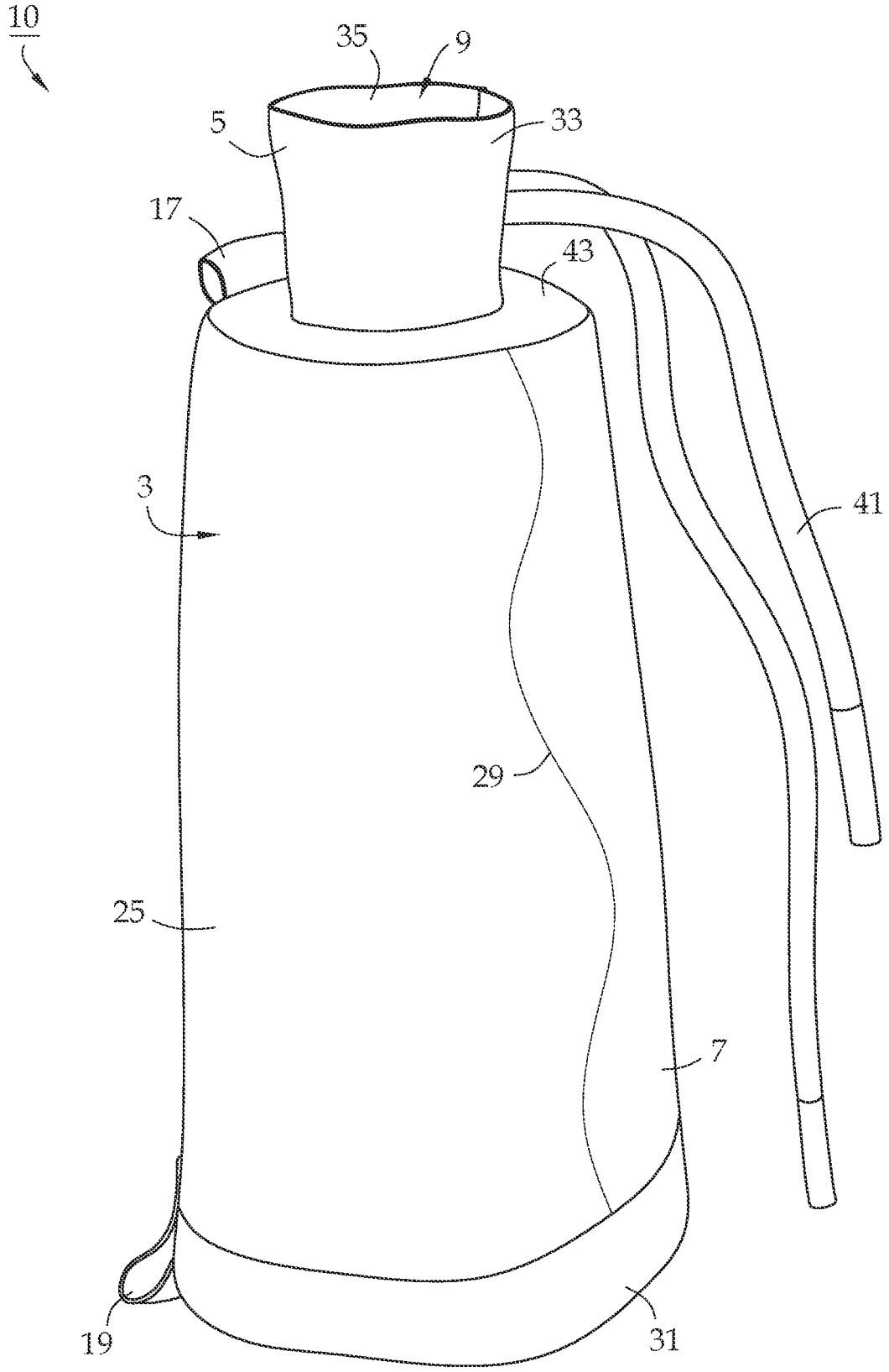
FIG. 1 shows a perspective view of the knot protector of the instant disclosure.

Various exemplary embodiments of the present disclosure are described below. Use of the term "exemplary" means illustrative or by way of example only, and any reference herein to "the disclosure" is not intended to restrict or limit the disclosure to exact features or step of any one or more of the exemplary embodiments disclosed in the present specification. References to "exemplary embodiment", "one embodiment", "an embodiment", "various embodiments", and the like may indicate that the embodiment(s) of the disclosure so described may include a particular feature, structure, or characteristic, but not every embodiment necessarily incudes the particular feature, structure, or characteristic. Further, repeated use of the phrase "in one embodiment", "in an exemplary embodiment", or "in an alternative embodiment" do not necessarily refer to the same embodiment, although they may.

It is also noted that terms like "preferably", "commonly", and "typically" are not utilized herein to limit the scope of the disclosure or to imply that certain features are critical, essential, or even important to the structure or function of the disclosure. Rather, these terms are merely intended to highlight alternative or additional features that may or may not be utilized in a particular embodiment of the present disclosure.

The present disclosure is described more fully hereinafter with reference to the accompanying figures, in which one or more exemplary embodiments of the disclosure are shown. Like numbers used herein refer to like elements throughout. The disclosure may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limited as to the scope of the disclosure, and any and all equivalents thereof. Moreover, many embodiments such as adaptations, variations, modifications, and equivalent arrangements will be implicitly disclosed by the embodiments described herein and fall within the scope of the instant disclosure.

Although specific terms are employed herein, they are used in a generic and descriptive sense only and not for the purposes of limitation. Unless otherwise expressly defined herein, such terms are intended to be given their broad, ordinary, and customary meaning not inconsistent with that applicable in the relevant industry ad without restriction to any specific embodiment hereinafter described. As used herein, the article "a" is intended to include one or more items. Where only one item is intended, the terms "one and only one", "single", or similar language is used. When used herein to join a list of items, the term "or" denotes at least one of the items but does not exclude a plurality of items of the list.

For exemplary methods or processes of the disclosure, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present disclosure.

Additionally, any references to advantages, benefits, unexpected results, or operability of the present disclosure are not intended as an affirmation that the disclosure has previously been reduced to practice or that any testing has been performed. Likewise, unless stated otherwise, use of verbs in the past tense (present perfect or preterit) is not intended to indicate or imply that the disclosure has previously been reduced to practice or that any testing has been performed.

For a better understanding of the disclosure and its operation, turning now to the drawings, FIGS. 1-8 illustrate the preferred embodiments for knot protector 10. Throughout the description and illustrations, knot protector 10 is represented as a sleeve 3, preferably defining an upper portion 5, lower portion 7, and shoulder portion 43. Knot protector 10 is designed to receive a knot 15 from a rope 13 which is then positioned within the upper portion 5 of the sleeve 3 as pictured in FIG. 7. Sleeve 3 is ideally formed from durable material which protects the rope 13 from abrasion imparted from ledges, rocks, railings, edges, walls, cliffs, and other surfaces that may cause the fibers of the rope 13 to be gradually abraded or even destroyed.

In the preferred embodiment, knot protector 10 includes a sleeve 3 formed from upper and lower portions 5, 7. Sleeve 3 is also preferably in the shape of a tapered bottle as shown throughout the Figures and though not a limitation, may preferably define a length of 9.6 inches and a width of 5.5 inches. Preferably, sleeve 3 is formed from a deformable, continuous web and includes exterior and interior layers 25, 27, respectively. Both exterior and interior layers 25, 27 may preferably define a herringbone nylon weave material, although the respective layers defining the same material and/or weave pattern is not required. Exterior layer 25 is ideally formed from a 1000 denier nylon material. Additionally, the herringbone nylon weave of exterior layer 25 is preferably formed from a 0.25 inch thick nylon webbing. It is also a preference for the color of exterior layer 25 to be of a dark color, such as black although such is not a limitation of the current disclosure.

Figure 2:
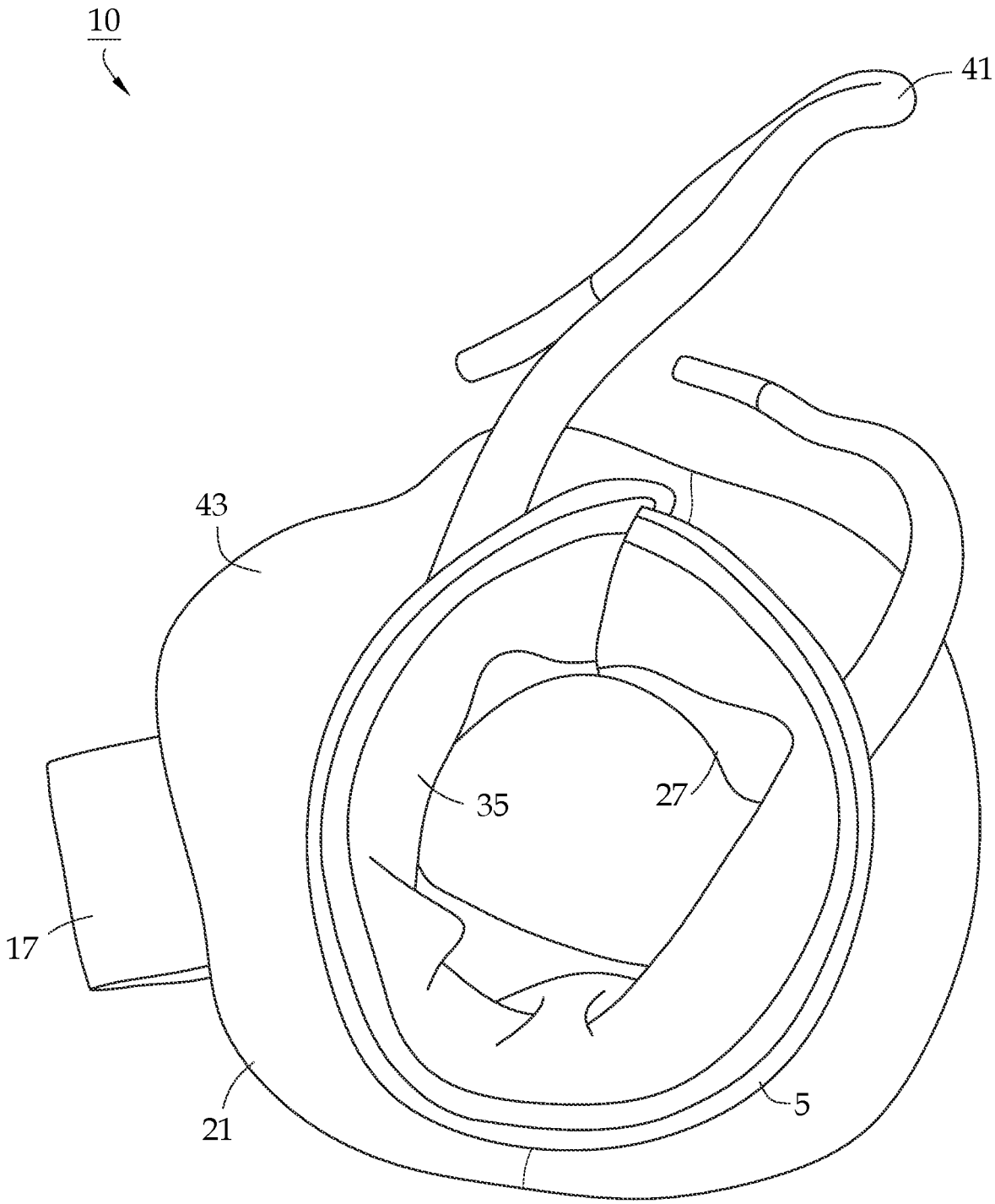
FIG. 2 pictures a top plan view of the knot protector of FIG. 1 in the open configuration.
Figure 3:
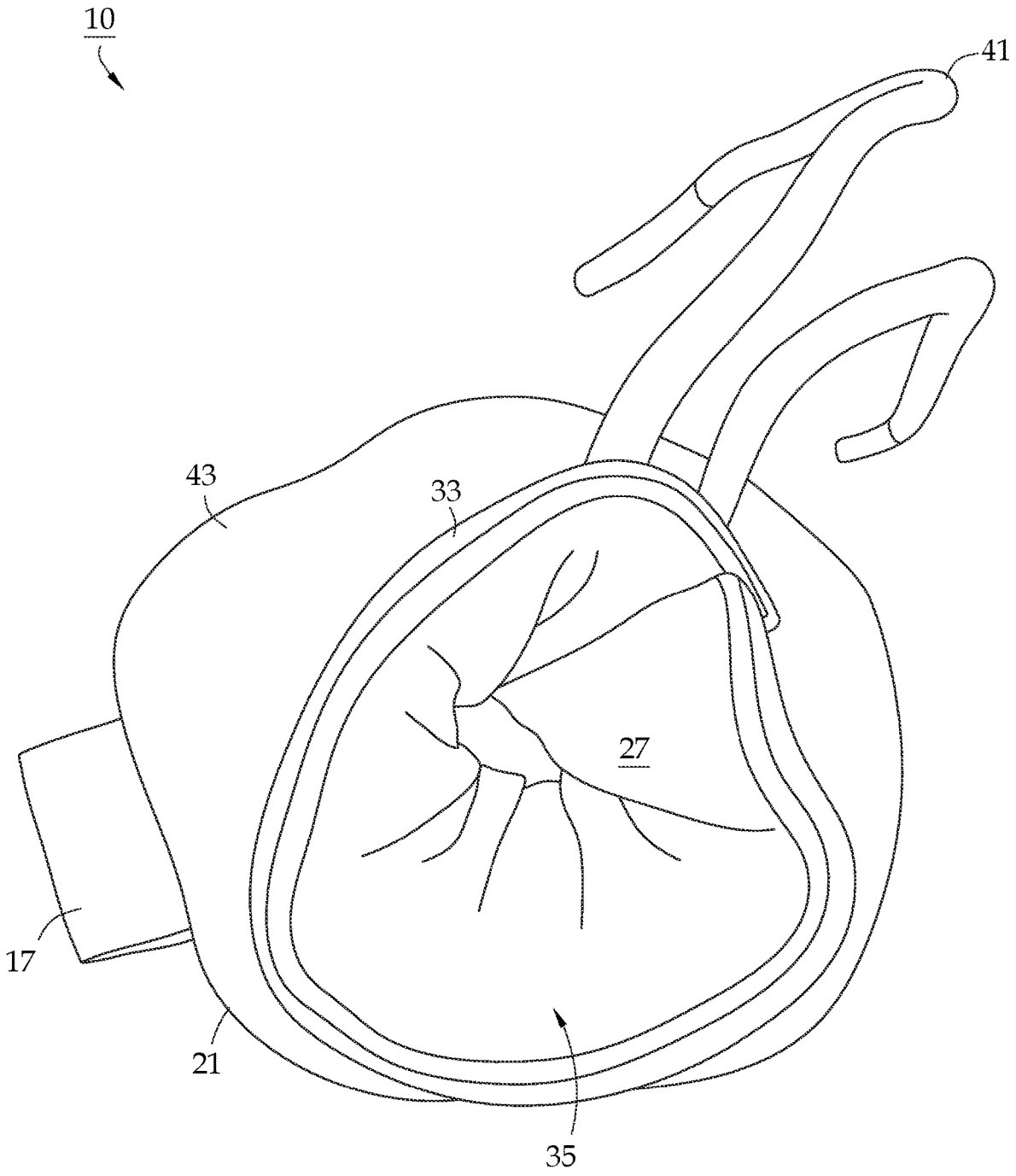
FIG. 3 depicts a top plan view of the knot protector of FIG. 1 in the closed configuration.

Interior layer 27 is preferably formed from a 1000 denier nylon material and/or a 1680 denier nylon material. It is a preference for the color of interior layer 27 to be of a high visibility color, such as yellow, orange or lime green for easy detection. The term "high-visibility color" (or "hi-vis" for short) in this context is understood to include all high-visibility apparel embodiments as defined by ANSI/ISEA 107-2015, including Type O, Type R, and Type P embodiment types of 20 Class 1, 2, 3, E, and Optional High-Visibility Accessory performance classes. Although preferred, the listed material(s) is/are not to be construed as a limitation of the current disclosure. One preferred use for interior layer 27 to be of a high visibility color such that as exterior layer 25 begins to wear, the high contrast color will begin to become visible, telegraphing through and alert the user that the protection afforded by knot protector 10 has been compromised; for instance in circumstances where knot protector 10 experiences a high degree of friction or abrasion during a single use, or over many uses. In certain embodiments, interior layer 27 may only be visible from a top view as shown in FIGS. 2-3, or from a bottom view as shown in FIG. 4.

It is a preference to secure exterior layer 25 and interior layer 27 to one another by reflective stitching 29. An example of an acceptable reflective thread is the reflective thread offered commercially by Ki-Shin Corp., which is a 2000 denier, three filament thread with a tenacity of ~3800 cN. This, however, is not a limitation of the present disclosure, and other acceptable filaments as known in the art are considered within the present scope. Tapes, appliques, and powered illumination sources may also be incorporated as desirable.

Figure 4:
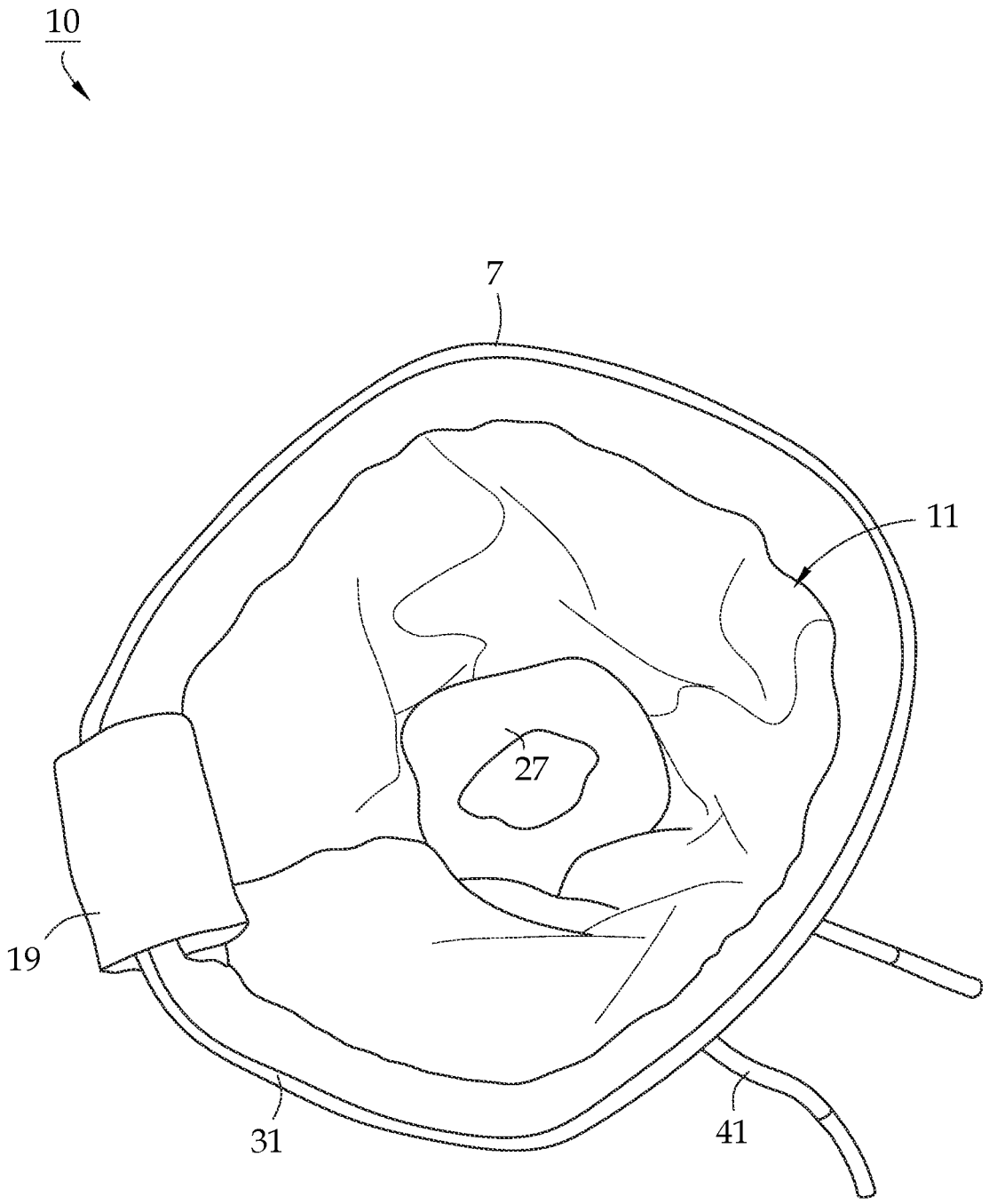
FIG. 4 demonstrates a bottom plan view of the knot protector of FIG. 3.
Figure 5:
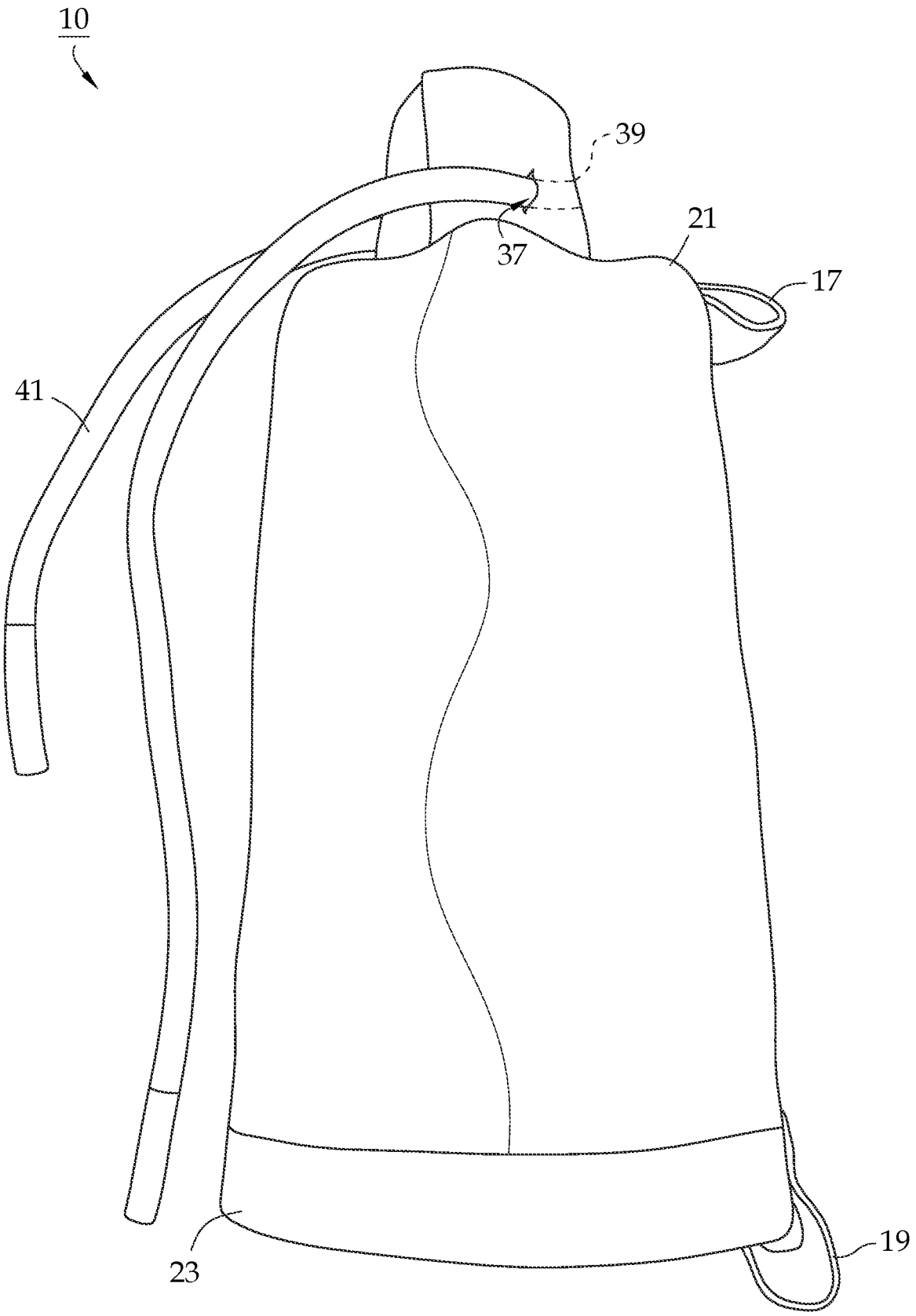
FIG. 5 illustrates a perspective side view of the knot protector of FIG. 1.
Figure 6:
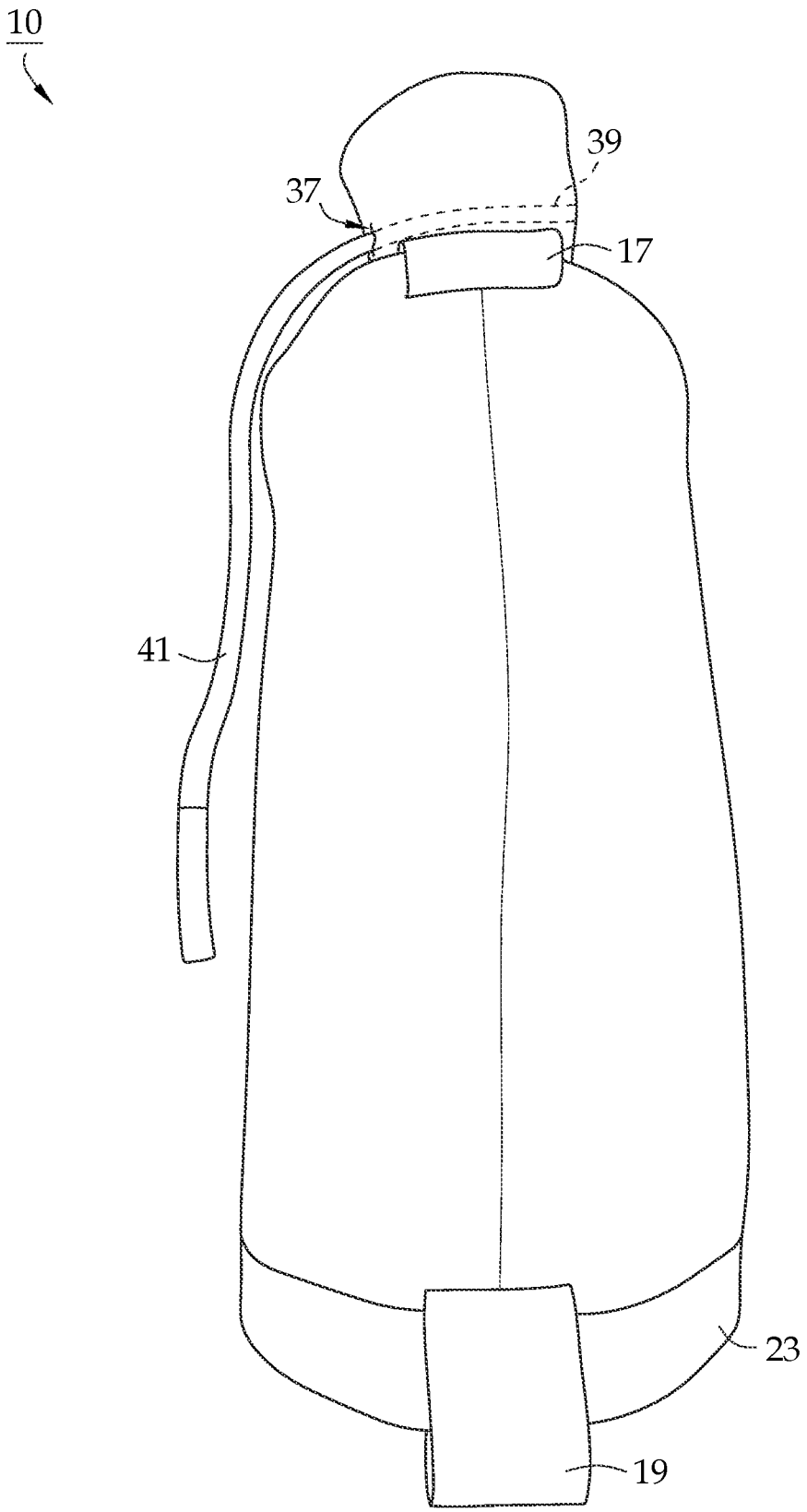
FIG. 6 features an elevated rear view of the knot protector of FIG. 1.

In the preferred embodiment, upper portion 5 of sleeve 3 defines one or more openings, and more preferably, a first opening 9 and lower portion 7 defines one or more openings, and more preferable a second opening 11 (FIG. 4). Upper portion 5 is cylindrically shaped and though not a limitation, may define a length of 2 inches. When flattened, upper portion 5 may define a width of 2.25 inches. First opening 9 features a circular atrium in the preferred embodiment. Furthermore, an embodiment of first opening 9 defines a diameter that is less than that of second opening 11. Ideally, sleeve 3 of the preferred embodiment further defines a shoulder portion 43 positioned between upper portion 5 and lower portion 7. Shoulder portion 43 forms the shape of a circle, however is not limited to this shape. In the preferred embodiment, shoulder portion 43 has a radius of 0.75 inches. Preferably, shoulder portion 43, upper portion 5, and lower portion 7 are continuous, such that they combine into a single member and define sleeve 3.

Preferred upper portion 5 of sleeve 3 further defines an exterior surface 33 and an interior surface 35. Exterior surface 33 may define one or more orifices 37 (FIGS. 5 and 6), however it is a preference that exterior surface 33 include two orifices 37. The orifices 37 are preferably circular but may define other shapes. It is a further preference to define a cavity 39 (indicated in phantom) between the exterior and interior surfaces 33, 35, wherein the one or more orifices 37 are in communication via the cavity 39. In the preferred embodiment, a string 41 is positioned within the cavity 39 and exits the one or more orifices 37, wherein the string 41 is configured to tighten the upper portion 5 of sleeve 3 around the knot 15 of the rope 13, or in certain embodiments rope 13 itself to prevent inadvertent dislodgement. String 41 is preferably made from 1000 denier nylon material and defines a herringbone nylon weave formed from a 0.25 inch thick nylon webbing, similar to the sleeve 3 material. Ideally, string 41 is formed from a high visibility color for easy detection, such as yellow, orange or lime green, and may also include other colors such as black. It is also a preference for string 41 to include a small sheath or aglet, often made of plastic or metal and used on each end of a shoelace, cord, or drawstring. In the preferred embodiment, the aglet is preferably of a high visibility color, such as yellow, orange or lime green.

Figure 7:
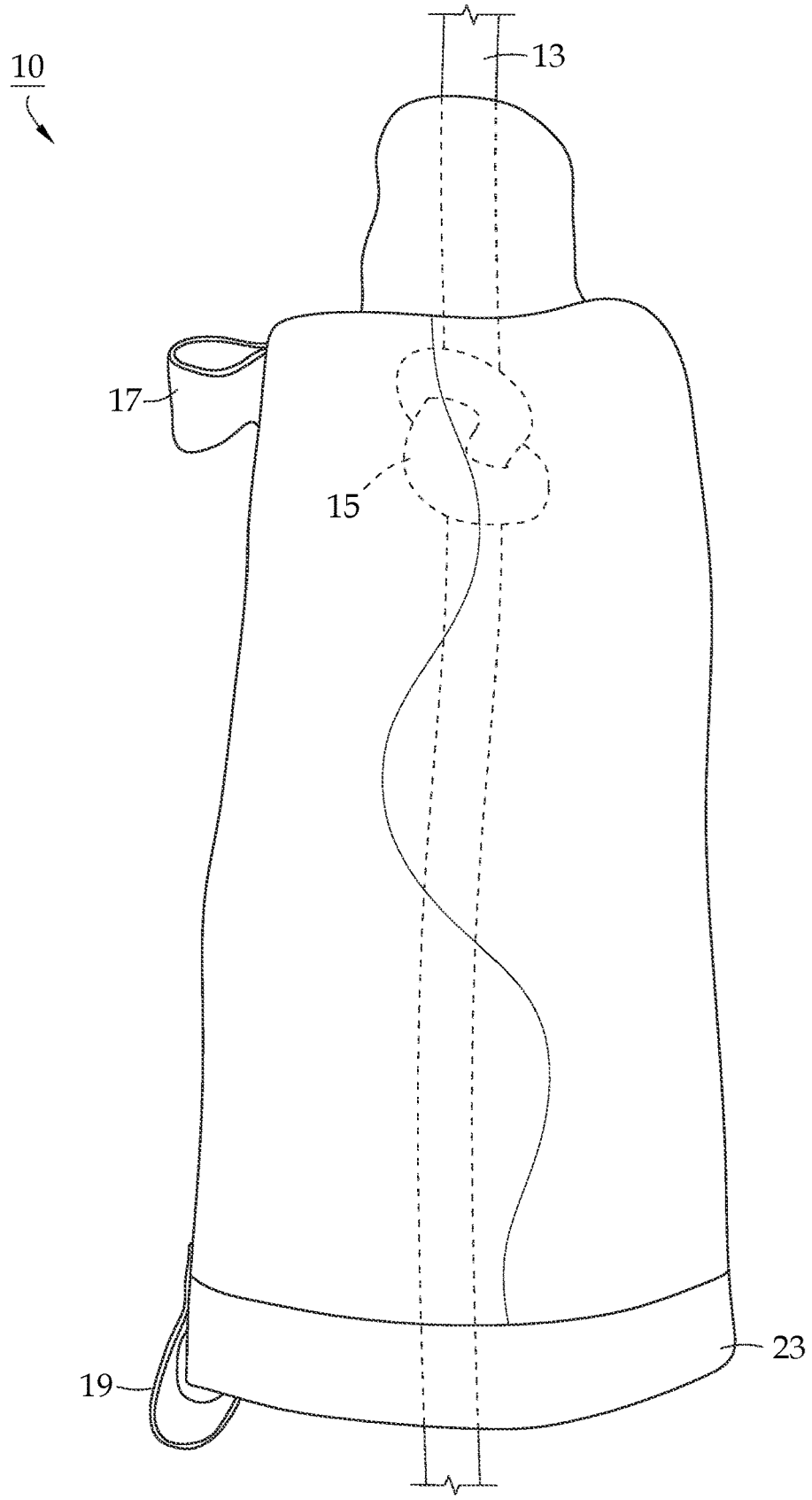
FIG. 7 shows a perspective side view of the knot protector of FIG. 1.
Figure 8:
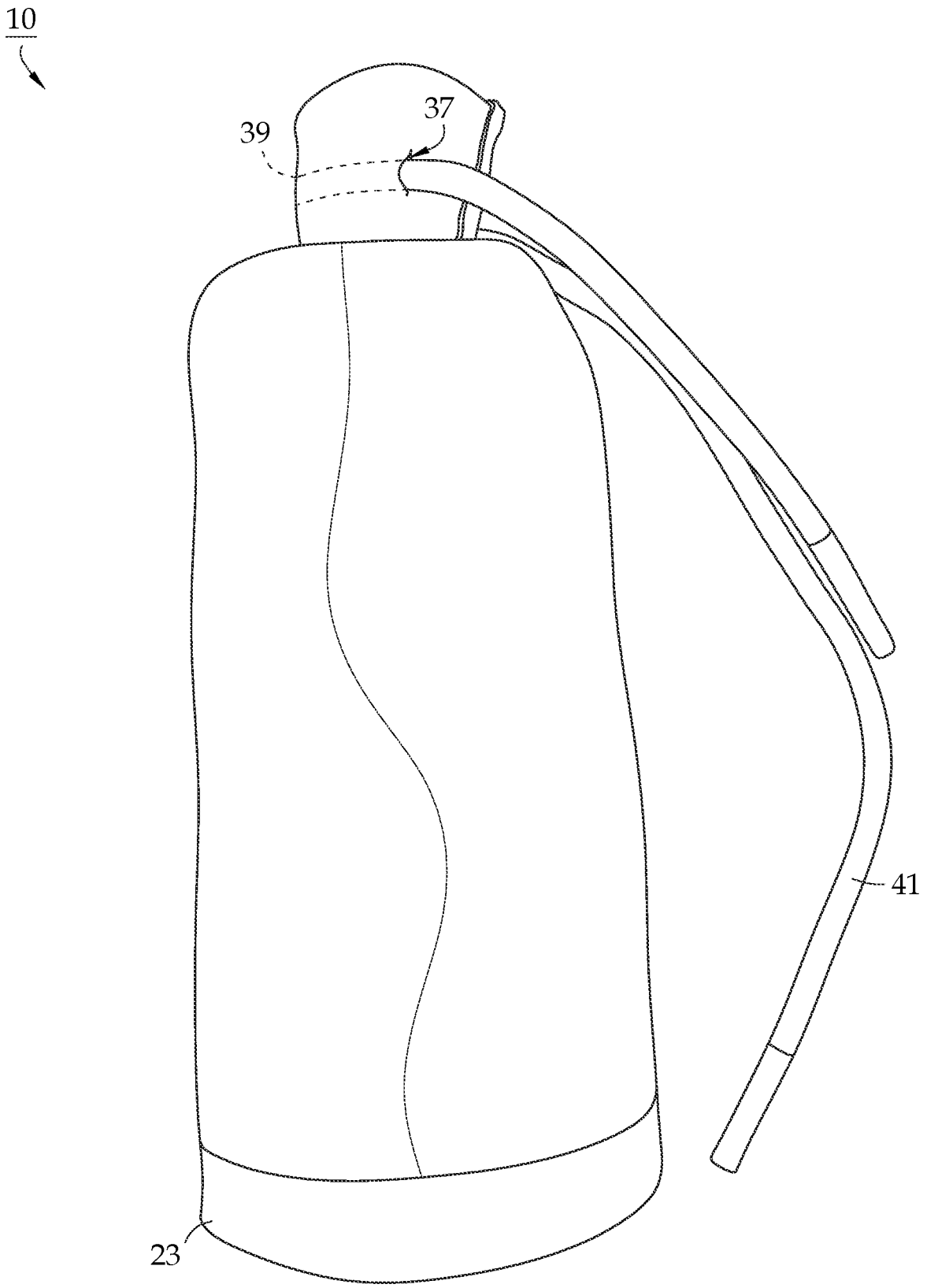
FIG. 8 illustrates a perspective side view of the knot protector of FIG. 1.

Lower portion 7 of sleeve 3 preferably defines a second opening 11 which is larger than the diameter of the upper portion 5. The lower portion 7 also features a circular atrium which can be viewed from the bottom view as shown in FIG. 4. In the preferred embodiment, the lower portion 7 of sleeve 3 includes one or more receptacle loops 17, 19, however it is a preference to include two receptacle loops 17, 19 as seen in FIG. 7. A first receptacle loop 17 is located along the top section 21 (FIG. 5) of the lower portion 7 and a second receptacle loop 19 is located along the base section 23 of the lower portion 7. The lower portion 7 of sleeve 3 may also contain one or more visual safety indicators 31 along the base section 23 of lower portion 7 to provide visibility. It is a further preference for the visual safety indicators 31 to be formed from fluorescent material and to be of a high visibility color, such as yellow, orange or lime green.

Figure 9:
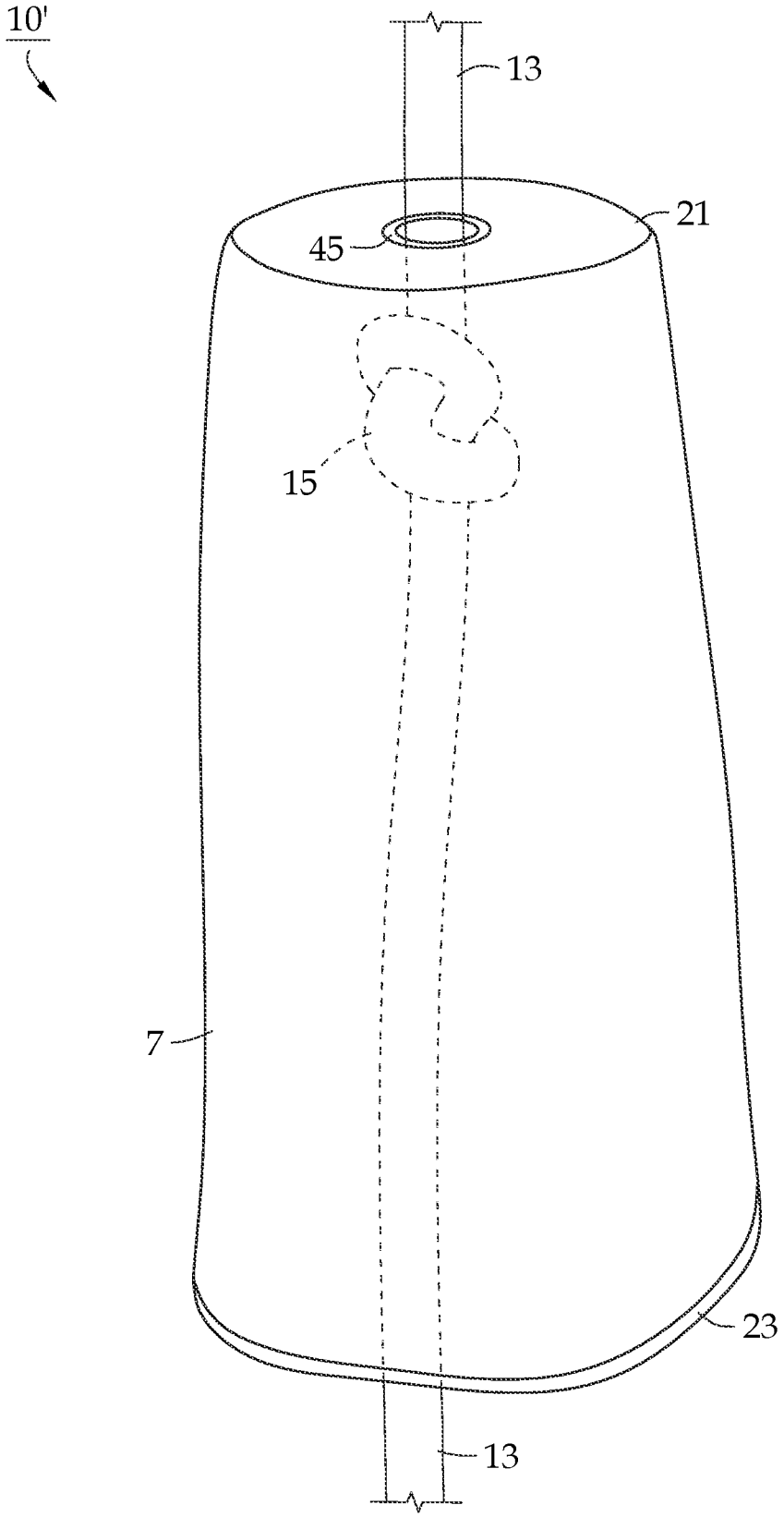
FIG. 9 depicts a top plan view of an alternative embodiment of the knot protector of FIG. 1.

In a second embodiment shown in FIG. 9, knot protector 10' defines the lower portion 7, a top section 21, and a base section 23. This embodiment does not include the upper portion 5 or the shoulder portion 43. In this embodiment, the top section 21 includes one or more grommets 45, a piece of metal hardware that can be inserted into a hole in a piece of fabric to bestow certain structural stability. The one or more grommet(s) is/are positioned within the top section 21 of the lower portion 7. In one embodiment, the knot 15 of the rope 13 is positioned below the grommet while the grommet's position prevents the knot 15 from sliding through the top section 21 of the lower portion 7.

The illustrations and examples provided herein are for explanatory purposes and are not intended to limit the scope of the appended claims.

I claim:

1. A knot protector (10) configured to receive a knot (15) from a rope (13), the knot protector (10) comprising:

a sleeve (3) defining a top section (21) and a base section (23), and formed from a deformable, continuous web spanning between the top section (21) and the base section (23);

the top section (21) defining a first opening (9) further defining a first dimension; and the base section (23) defining a second opening (11) further defining a second dimension;

wherein the first opening (9) is sized to slidingly receive a rope (13) therethrough and abut a knot (15) from the rope (13) and prevent the knot (15) from passing through the first opening (9), and wherein the first dimension is always less than the second dimension.

2. The knot protector (10) of claim 1, wherein the first dimension is greater than a dimension of the rope (13).

3. The knot protector (10) of claim 1, wherein the sleeve (3) includes one or more receptacle loops (17, 19).

4. The knot protector (10) of claim 3, wherein the one or more receptacle loops (19) are positioned along the base section (23).

5. The knot protector (10) claim 1, wherein one or more grommet(s) (45) are positioned within the first opening (9) to prevent the knot (15) from the rope (13) from sliding through the top section (21).

6. The knot protector (10) of claim 1, wherein the sleeve (3) comprises one or more visual safety indicators (31).

7. The knot protector (10) of claim 1, wherein the sleeve (3) is defined by a plurality of material layers.

8. The knot protector (10) of claim 7, wherein the plurality of material layers are secured by reflective stitching (29).

9. A knot protector (10) configured to receive a knot (15) from a rope (13), the knot protector (10) comprising:

a sleeve (3) formed from a deformable, continuous web and defining an upper portion (5), a lower portion (7), and a shoulder (43) positioned between upper portion (5) and lower portion (7);

the upper portion (5) includes a top section (21) defining a first opening (9) further defining a first dimension; and the lower portion (7) includes a base section (23) defining a second opening (11) further defining a second dimension;

wherein the first opening (9) is sized to slidingly receive a rope (13) therethrough and abut a knot (15) from the rope (13) and prevent the knot (15) from passing through the first opening (9), wherein the first dimension is always less than the second dimension.

10. The knot protector (10) of claim 9, wherein the first dimension is greater than a dimension of the rope (13).

11. A knot protector (10) of claim 9, wherein the sleeve (3) includes one or more receptacle loops (17, 19).

12. The knot protector (10) of claim 9, wherein one or more receptacle loops (17) are positioned along the top section (21).

13. The knot protector (10) of claim 9, wherein a first receptacle loop (17) is located along the top section (21) and a second receptacle loop (19) is located along the base section (23).

14. The knot protector (10) of claim 9, wherein the sleeve (3) comprises one or more visual safety indicators (31).

15. The knot protector (10) of claim 9, wherein the sleeve (3) is defined by a plurality of material layers.

16. The knot protector (10) of claim 15, wherein the plurality of material layers are secured by reflective stitching (29).

17. The knot protector (10) of claim 9, wherein the upper portion (5) defines an exterior surface (33) and an interior surface (35) with one or more orifices (37) formed in the exterior surface (33), a cavity (39) defined between the interior surface (35) and the exterior surface (33), the one or more orifices (37) in communication via the cavity (39).

18. The knot protector (10) of claim 17, wherein a string (41) is positioned within the cavity (39) and exits the one or more orifices (37), wherein the string (41) is configured to tighten the upper portion (5) of the sleeve (3) around the knot (15) of the rope (13).

* * * * *